US005346195A

United States Patent [19]

Heimann et al.

[11] Patent Number: 5,346,195

[45] Date of Patent: Sep. 13, 1994

[54] APPARATUS AND METHOD FOR INDEXING SHEETS

[75] Inventors: Edward W. Heimann, Woodridge; Thomas E. Dash, Auroa, both of Ill.

[73] Assignee: Wallace Computer Services, Inc., Hillside, Ill.

[21] Appl. No.: 4,526

[22] Filed: Jan. 14, 1993

[51] Int. Cl.[5] ..... B65H 41/00

[52] U.S. Cl. ..... 270/52.5; 270/58; 83/38; 83/94; 83/299; 83/311

[58] Field of Search ..... 270/52.5, 58; 83/38, 83/92, 94, 302, 299, 311, 408, 155

[56] References Cited

U.S. PATENT DOCUMENTS

| | | | |
|---|---|---|---|
| 2,180,203 | 11/1939 | Hallden . | |
| 2,204,067 | 6/1940 | Bruker . | |
| 2,205,537 | 6/1940 | Nye . | |
| 2,214,488 | 9/1940 | Stern et al. . | |
| 2,376,763 | 5/1945 | Fitchett . | |
| 3,375,744 | 4/1968 | Schieven . | |
| 4,255,998 | 5/1981 | Rudszinat | 83/299 |
| 4,577,789 | 3/1986 | Hofmann et al. | 270/52.5 |
| 4,939,888 | 7/1990 | Katz et al. | 270/52.5 |
| 5,065,992 | 11/1991 | Crowley . | |
| 5,072,637 | 12/1991 | Reichental et al. | 83/155 |
| 5,110,101 | 5/1992 | Roth | 270/52.5 |
| 5,149,075 | 9/1992 | Crowley et al. | 270/52.5 |
| 5,159,384 | 10/1992 | Donahue | 270/52.5 |
| 5,211,383 | 5/1993 | Valentinis | 270/58 |

*Primary Examiner*—John T. Kwon

*Attorney, Agent, or Firm*—Tilton, Fallon, Lungmus & Chestnut

[57] ABSTRACT

Apparatus and method for indexing sheets cut from a web including a production line having an unwind at one end and a backstop at the other end, a printer and a rotary knife between the ends, the relation of the knife speed to the web speed being changed cyclically to develop longer and shorter sheets.

10 Claims, 5 Drawing Sheets

APPARATUS AND METHOD FOR INDEXING SHEETS

BACKGROUND AND SUMMARY OF INVENTION:

This invention relates to apparatus and method for indexing sheets and, more particularly, to the indexing of multi-page reports where separator sheets protrude outwardly between adjacent copies of the stacked reports.

It is known to index zig-zag folded forms as, for example, seen in U.S. Pat. No. 5,065,992. There, the trailing panel of one set and the leading panel of an adjacent set were of different lengths so that the longer of the two would protrude to serve as a visual separator. The zig-zag forms were less preferable than individual sheets because they required special binders and also if separated into individual sheets subsequently required a bursting step which very often left ragged edges where the perforation bonds had occurred.

It is also known to indicate the presence of a flawed sheet by having the same protrude as seen in U.S. Pat. No. 3,375,744. Still further, it is known to index or tab sheets via a guillotine cutter so as to provide different lengths as stack separators. In such a case, the sheet advance is intermittent which is speed limiting. Also the stationary knife operation creates problems in subsequent sheet handling.

According to the instant invention, sheets are provided in set or report form, i.e., a predetermined number of sheets or pages per set or report and which are separated by longer and shorter sheets than those in the set or report. This is all done continuously by means of cyclically varying the speed relationship between the web and the rotary cutter associated with the printer which sets down the report information.

BRIEF DESCRIPTION OF DRAWING

The invention is described in conjunction with the accompanying drawing in which.

DETAILED DESCRIPTION

Summary of Operation

Figure 1:
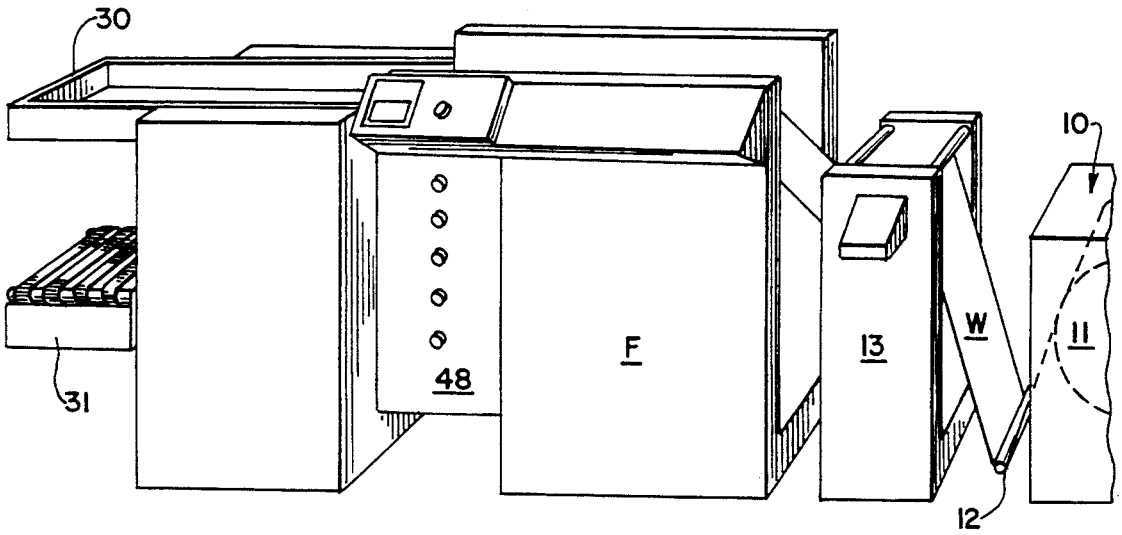
FIG. 1 is a perspective view taken from the operator's side of the apparatus.
Figure 2:
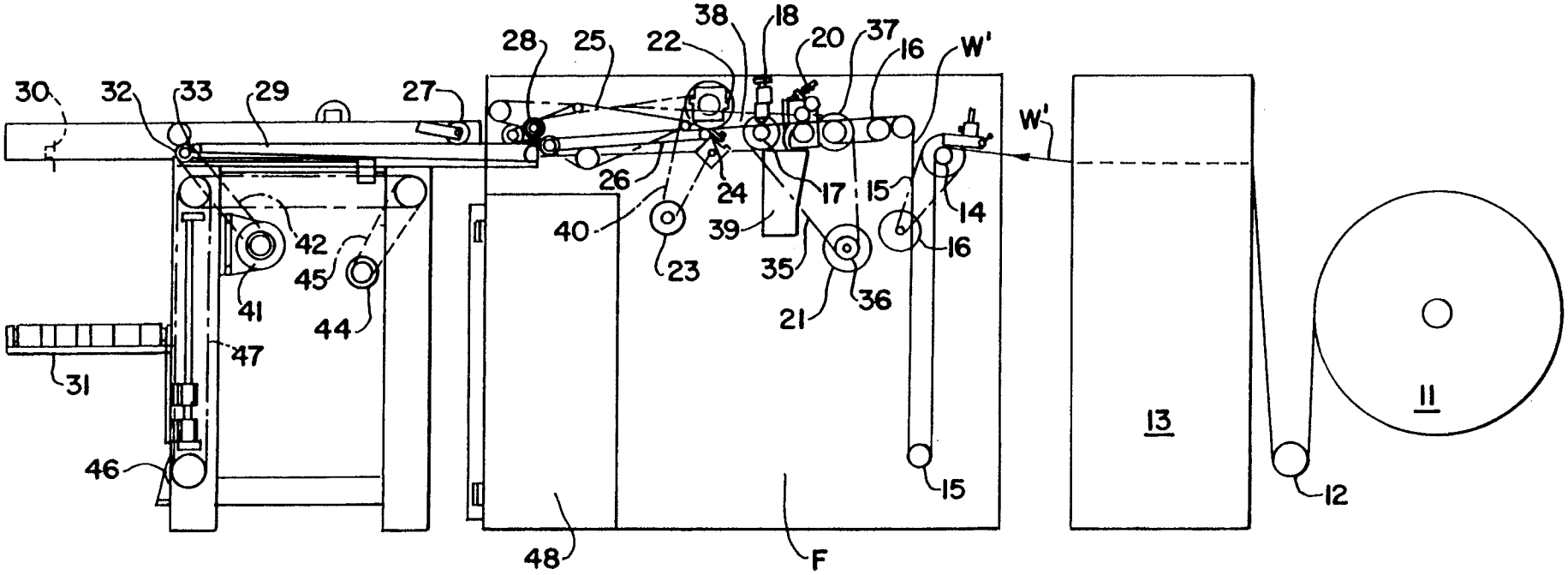
FIG. 2 is a side elevational view essentially schematic) of the apparatus as viewed again from the operator's side.

From FIGS. 1 and 2, it will be seen that at the extreme right there is an unwind generally designated 10 which rotatably supports a source or jumbo roll 11 from which a web W is unwound. After passing around an idler roll 12 the web enters the printer 13 for printing successive pages of a report or the like.

The printed web W′ is advanced from the printer by one of many means known to exist, one such being a drive roll. The aforementioned is one of many possible means of feeding or advancing the web W′ into the frame F.

Figure 8:
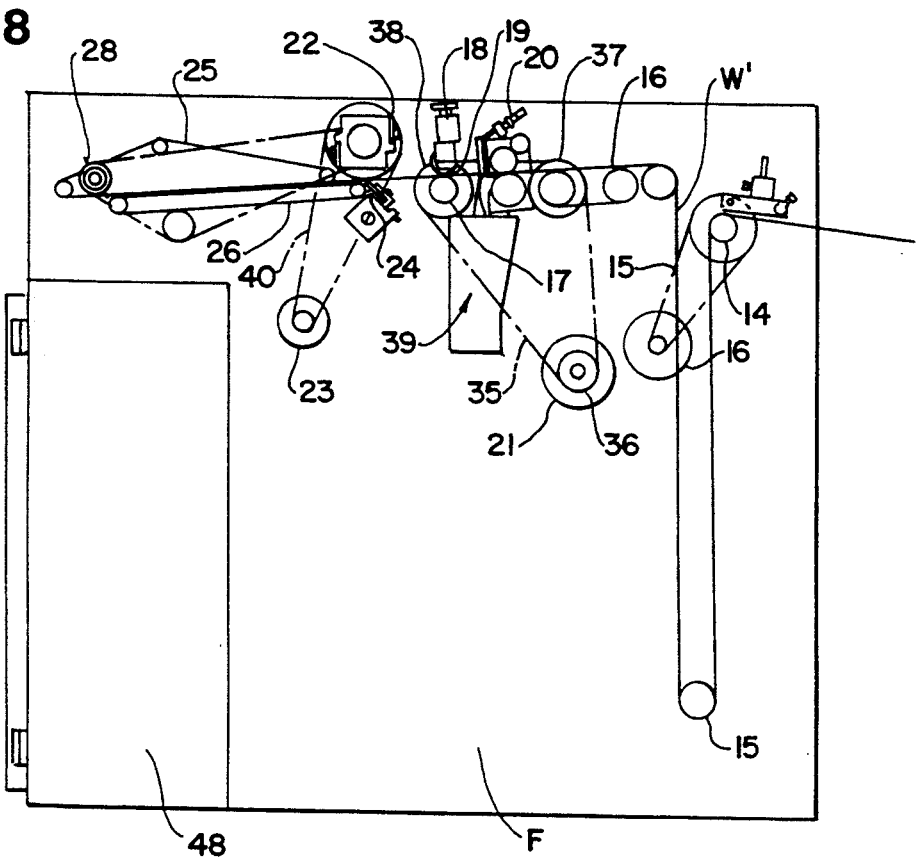
FIG. 8 is a side elevational view of a portion of the apparatus as viewed from the operator's side.
Figure 9:
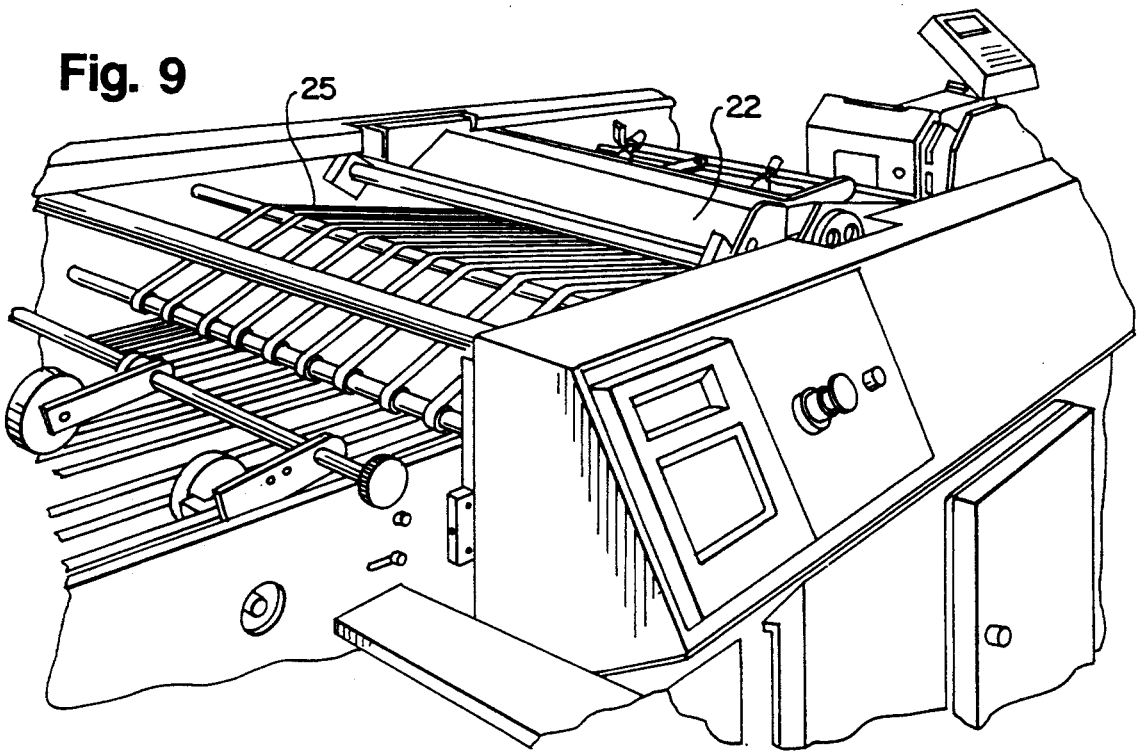
FIG. 9 is an enlarged fragmentary perspective view of the central portion of the apparatus of FIG. 8 again as taken from the operator's side.

Now referring to FIGS. 2 and 8, the web W′ passes around the drive roll 14 and proceeds through a dance roll or tension mechanism generally designated 15. The web W′ is advanced in this by means of pin feed tractor belts 16 which operate in conjunction with control punch margins provided on the longitudinal side edges of the web W or W′.

The still continuous web W′ can now be advanced i.e., pulled by means of a nip 19 between pull roll 17 and trolley wheel 18 through a slitter 20 which removes the control punch margins. The tractor belts 16 are driven by a motor 21 which also drives the slitter 20 and the pull roll 17.

Still referring to FIGS. 2 and 8, the web W′ is introduced into the rotary knife and which includes a rotating upper knife element 22 (driven by motor 23) and a stationary lower knife 24. This results in the web W′ being transversely severed into successive sheets. Either by cyclically changing the speed of the web feed motor 21 or the speed of the knife motor 23 the length of the sheet may be varied. It is preferred to vary the web speed by cycling the motor 21 but in some instances it may be advantageous to vary the knife speed instead.

The rotating upper knife has some effect in imparting a velocity to the cut sheet and introduces it into a nip provided by upper and lower belts 25 and 26 respectively. These belts operate at a faster speed than the pull roll 17 and tractor belts 16 so that the now-resultant sheets separate and continue forward with a gap between them. These sheets are advanced by belts 25 and 26 until the leading edge reaches the slowdown wheels 27 (FIG. 7). At this time the brush-equipped knock down mechanism 28 (see FIG. 8) is displacing the trailing end of the sheet away from the belt 25. The combination of the slow down wheel 27 and knock down mechanism 28 causes the sheets to then travel at the speed of belt system 29 which operates at a substantially slower speed than belts 25 and 26 so that the resultant sheets slow down and form a shingled array by virtue of the leading end of a following sheet advancing to the top of the now-slowed down trailing end of the preceding sheet. These sheets which are in a shingled array are then advanced by belt system 29 to stop 30 where they are developed into a stack on elevator 31 (see FIGS. 5–7).

When elevator 31 is full or stack S is the desired size (number of sheets or job) the unload cycle is initiated. The cutter system continues to run and cut sheets. Belt system 29 stops thus halting the sheets in the shingled stream. Shaft 32 accelerates to a speed faster than the previous speed of belt system 29 and proceeds to unshingle the sheets at the appropriate sheet. A sensing means such as a photo eye 33 is utilized to detect when the shingle stream is separated. When this separation is detected elevator 31 begins to descend to position 31′. Belt system 29 and shaft 32 return to their previous shingling speed. Forks or supporting finger means 34

(see FIG. 5) are provided to support a new stack S while the previously formed stack or collection of reports S is lowered on elevator 31 and discharged from the machine (FIG. 7).

Figure 6:
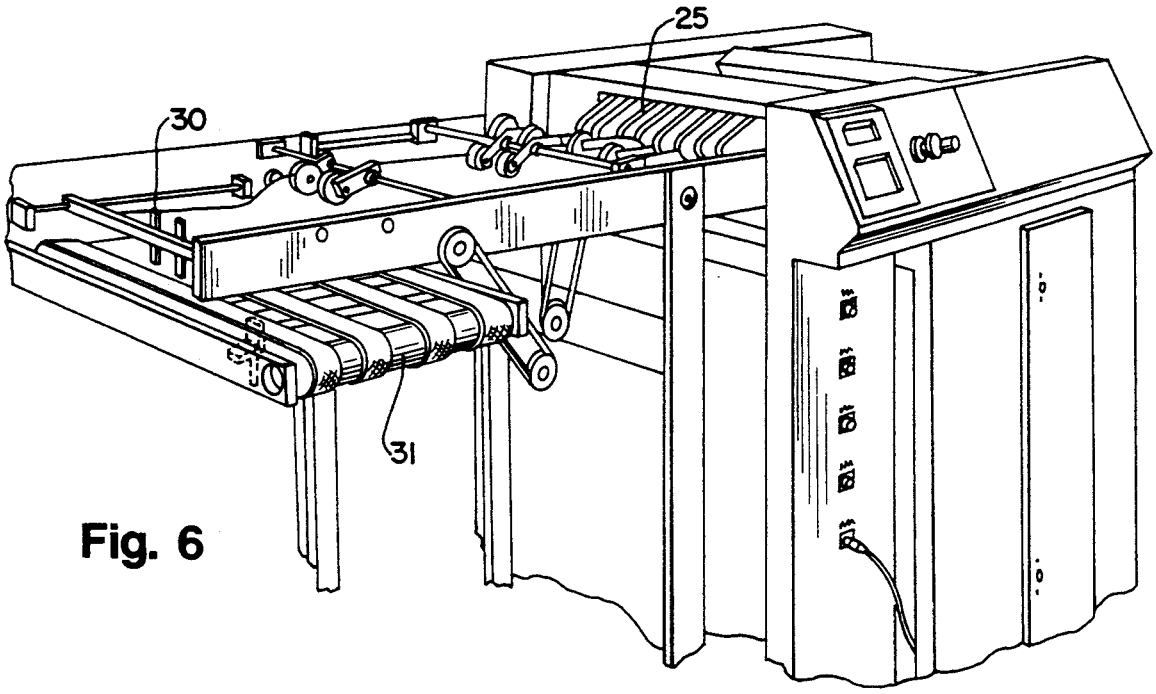
FIG. 6 is a further fragmentary perspective view of the discharge end of the apparatus taken from the operator's side also.
Figure 7:
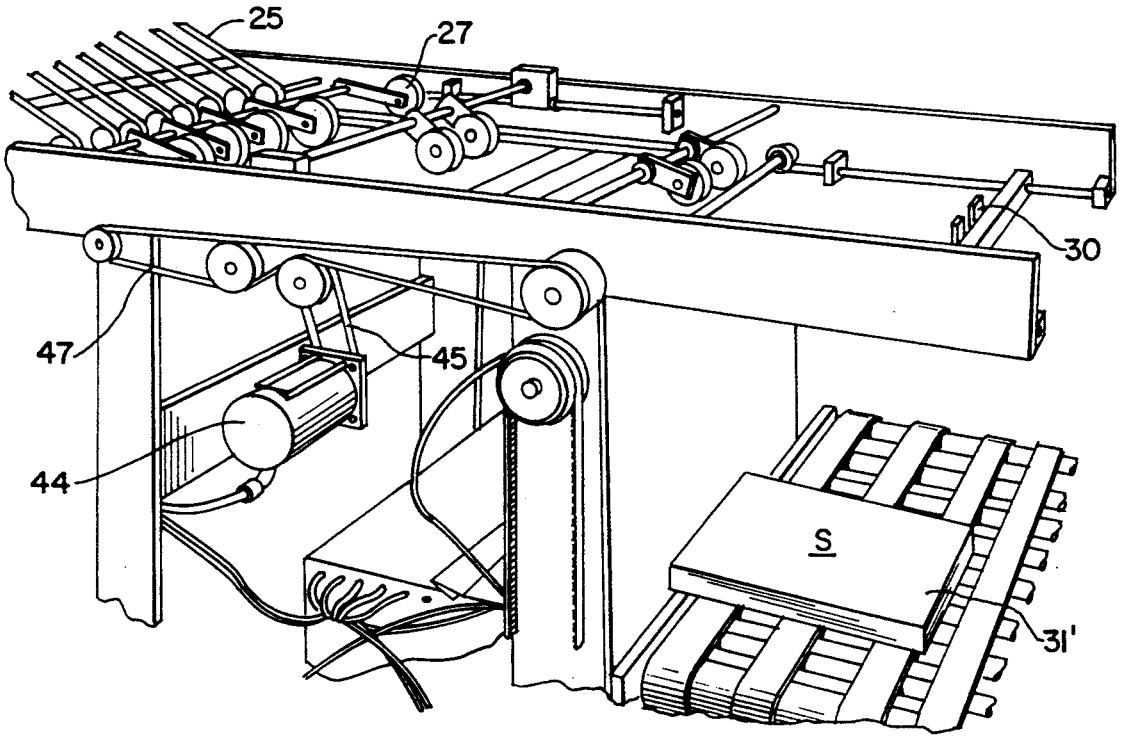
FIG. 7 is a fragmentary perspective view of the apparatus discharge end but taken from the drive side of the apparatus.

In FIG. 6, elevator 31 has returned to just below forks 34 which are now retracted allowing stack S to continue to form. Elevator 31 slowly descends as stack S increases in size.

The upper rotary cutter 22 or fly knife mechanism is intended to operate continuously so as to develop the various report or set pages. By cyclically varying the speed relationship between the web W' and the knife 22, two adjacent pages can be created of different lengths as at $R_1$ and $R_2$ in FIG. 3. For example, to create the shorter length sheet $R_1$, the rotary cutter is speeded up for one rotation and then slowed down beyond its normal rotational speed to create the longer sheet $R_2$. This is all done while the web is continuously and constantly advanced. After these two cycles have been performed, the cutter or fly knife 22 rotates at a constant speed to develop equal length pages as at $R_3$ for the rest of the report.

Figure 3:
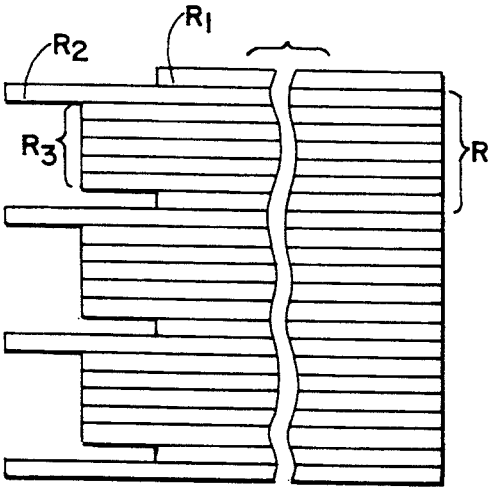
FIG. 3 is a schematic representation of a stack of sheets produced according to the invention.
Figure 4:
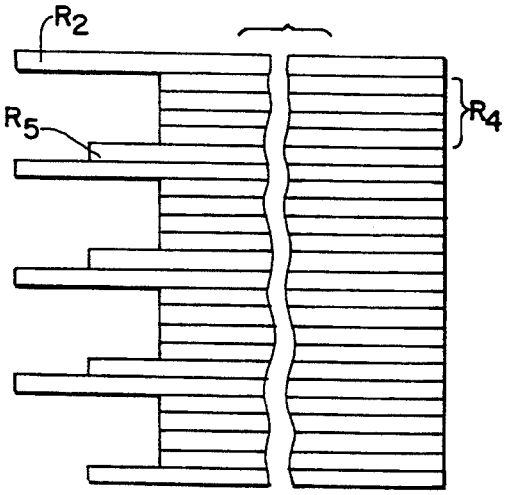
FIG. 4 is another schematic representation of a stack of sheets produced according to the invention.

It will be noted in FIG. 3 embodiment that there is a set or report R of seven sheets—each having a shorter sheet $R_1$ at one end and a longer sheet $R_2$ at the other end. The embodiment of FIG. 4 illustrates a report having six sheets where the four intermediate sheets $R_4$ are slightly shorter than the normal sheet $R_5$. In practice, there may be up to fifty "normal" sheets—or more. As before, there is a longer sheet $R_2$. If, for example, the projection of $R_2$ beyond the normal sheet $R_5$ is ⅛", this can be compensated for by making the four sheets $R_4$ each 1/32" shorter to compensate for the ⅛" extra length in sheet $R_2$. Then sheet $R_5$ and those following are of the standard length. The converse of this is also possible where $R_2$ is shorter and $R_4$ is longer. Still further, it is possible to have different lengths of sheet protruding. This can be advantageous in separating blocks of individual reports—as, for example, every tenth sheet $R_2$ can be longer than the adjacent nine.

Construction Details

In FIG. 8, after the web W' passes through the dance roll mechanism 15, it is engaged by a tractor belt mechanism 16 and pull rolls 17, 18. These rolls 17, 18 and mechanism 16 are driven by motor 21 through a drive generally design designated 35. The drive 35 has a drive pulley 36 mounted on the shaft of motor 21 and via a belt drives driven pulleys 37, 38. Pulley 37 is part of the belt mechanism 16 while pulley 38 is part of the pull roll 17. Gearing (not shown) connects the shaft of pulley 38 to the shaft of slitter 20.

The pull rolls 17, 18 feed the web through the slitter 20 which removes the control punch margins and directs them into the hopper 39

The pull rolls 17, 18 direct the web W' into the nip between upper rotary knife 22 and the lower stationary knife 24. The knife drive motor 23 has a belt and pulley drive 40 for rotating the knife 22.

Now proceeding further to the left in FIG. 8, the numerals 25 and 26 again designate upper and lower takeaway belt systems which receive the individual sheets cut from the web W' by the knife 22. As pointed out before, the knife 22 imparts an initial velocity to the cut sheet directing it into the nip between the upper and lower belt systems 25, 26. This is advantageous in that it occurs in each cutting cycle. So there is no problem in sheet handling as has been characteristic of the prior art—where there was no control over the cut sheet and which fell by gravity onto a stack.

Now referring to FIG. 2 and just downstream from the rotary knife, the belts 25 and 26 are also driven by motor 21 via drive belts from the pull roll 17. The belt system 29 is driven by motor 41 via drive 42.

Slow down of the sheets when traveling on belt system 29 is achieved by slow down wheels 27 (referring to FIG. 7). This results in a "shingling" on overlapping of sheets as at 43 in FIG. 5.

Figure 5:
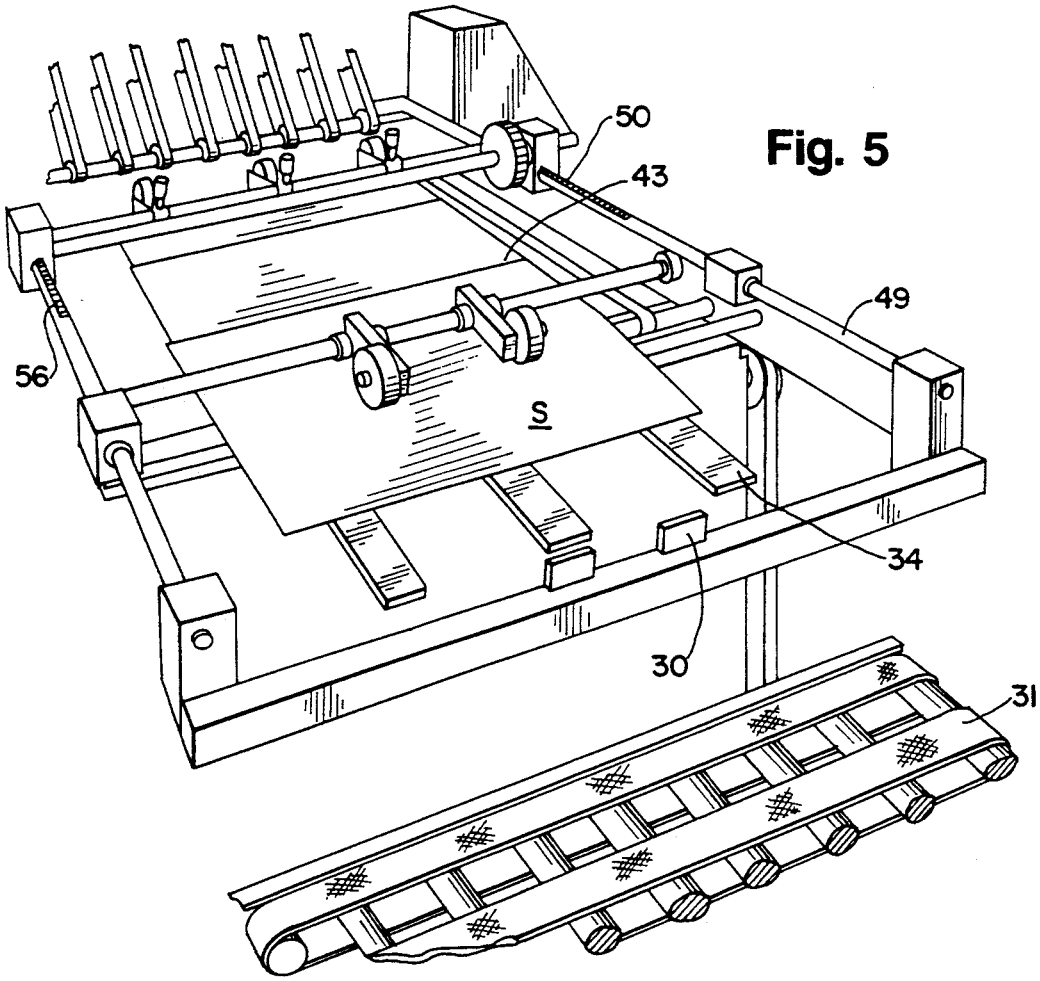
FIG. 5 is an enlarged fragmentary perspective view of the discharge end of the apparatus.

When a suitable number of sheets has been accumulated against the backstop bars 30 (center portion of FIG. 5), the elevator 31 is lowered and simultaneously therewith the fingers 34 extended to the FIG. 5 condition. The motor for providing finger movement can be seen at the left hand side of FIG. 7 at 44. A drive transmits motive power from the motor 44 via drive belt 45 which then imparts the motion to the forks 34.

Concurrently, motor 46 (see FIG. 2) delivers power to the elevator system generally designated 47 for lowering the elevator 31. The motors 41, 44 and 46 are all controlled by a controller 48 (see FIG. 1). So also is the rotary knife 22 or web W'. The controller 48 may be a Model DMC-700 Motion Controller produced by Galil Motion Control, Inc. of Sunnyvale, Calif. The controller or computer is employed, among other things, to control the speed relationship between the knife motor 23 and tractor motor 21 to develop the shorter/longer sheets $R_2$ and $R_1$ or $R_4$—see FIGS. 3 and 4. This can be in response to a scannable spot or pattern on the web, a signal from the computer to determine the number of pages, or there can be a preset count of revolutions between cyclic changes of the knife and/or web motor speeds. This may be controlled by controller 48 or other like means. The computer or controller controls all the machine functions.

In any event, once each set, the speed relationship of knife 22 and tractor 16 is changed so as to develop an index sheet $R_2$ (see FIGS. 3 and 6) which protrudes from the remaining sheets of the stack. The leading edge of each sheet engages and abuts the back stop 30 (see FIG. 5) so the trailing edge of the longer sheet protrudes on the upstream side and provides readily visible indication of the end of the report.

Once a stack is removed as from the elevator in the position 31' (see FIG. 7), it is only necessary to discard the sheets $R_1$ and $R_2$ and staple the remaining pages of the report for distribution. Normally, the starting and end pages of a report do not have data placed thereon inasmuch as the main frame software is generally a Jess III which automatically avoids printing necessary data on these sheets. Alternatively, all of the sheets may be employed or just the longer sheet $R_2$ may be discarded. It may be desirable to retain $R_2$ as an index tab in a binder containing several reports.

Operation

The numeral 13 designates generally a printer (see FIG. 1) which advantageously may be a laser printer or the like adapted to provide high speed printing of fixed or variable material on page lengths of the web or individual pages themselves if the rotary knife is positioned upstream of the printer. All of this is governed by a controller 48. The basic length of the report pages can be adjusted over a considerable size range—and when the "normal" length is changed, the position of the slow down wheels 27, the backstop bars 30 and the amount of extension of forks 34 can be changed by moving a carriage 49 along racks 50. Thus, we have provided means in the form of roll 11 and unwind 10 (see FIG. 1) at the first end of a production line for delivering web means for receiving printed information. At the other end we have provided back stop means 30 for receiving sheets cut from the web means with printed information on the sheets and arranged in indexed form for ready separation into individual reports with index sheets projecting toward the first end—see FIGS. 3 and 4.

Between the two ends we print the web means at 13 (FIG. 1) and also provide a rotary knife means 22 for producing report sheets wherein at least one end sheet (top or bottom) of each report is of different length from the other sheets. The knife means 22 transversely cuts the web W' which is advanced to it by pull rolls 17, 18 and advanced through the knife means by the knife means rotary motion.

We cyclically change the speed relationship of the knife means to the web means toward the knife means to develop a longer end sheet and a compensating length sheet or sheets adjacent thereto. This is done, as illustrated, by varying the speed of the tractor 16 over two or more cycles but also can be done by varying the speed of knife 2—this all while maintaining continuous motion of the web W with the printer 13.

While in the foregoing specification a detailed description of an embodiment of the invention has been set down for the purpose of illustration, many variations in the description hereingiven may be made without departing from the spirit and scope of the invention.

We claim:

1. A method for producing multi-page reports and the like which are provided in indexed, stacked form comprising the steps of providing means at one end of a production line for delivering web means for receiving printed information, providing backstop means at the other line end for receiving sheets cut from said web means with printed information on said sheets and arranged in indexed form for ready separation into individual reports with index sheets projecting toward said one end, printing said web means between said ends by applying printed information thereto by printer means, providing rotary knife means for producing report sheets wherein at least one end sheet of each report is of different length from the other sheets, continuously advancing said web means through said knife means and transversely cutting the same, and during said continuously advancing step cyclically changing the speed relationship of said knife means to the speed of said web means toward said knife means to develop said one end sheet and a compensating length sheet all while maintaining continuous motion with said printer means.

2. The method of claim 1 in which said steps include cyclically accelerating and decelerating said web means during the production of each report.

3. The method of claim 2 in which said steps include cyclically accelerating and decelerating the speed of said knife means during the production of each report.

4. A method for producing multi-page reports and the like which are provided in indexed, stacked form comprising the steps of providing means at one end of a production line for delivering web means for receiving printed information, providing backstop means at the other line end for receiving sheets from said web means with printed information on said sheets and arranged in indexed form for ready separation into individual reports with index sheets projecting toward said one end, printing said web means between said ends by applying printed information thereto by printer means, providing rotary knife means for producing report sheets wherein at least one end sheet of each report is of different length from the other sheets, advancing said web means through said knife means and transversely cutting the same, and cyclically changing the speed relationship of said knife means to the speed of said web means toward said knife means to develop said one end sheet and a compensating length sheet all while maintaining continuous motion with said printer means, providing upper and lower belt systems defining a nip and directing said cut sheets toward and into said nip, and shingling said cut sheets thereafter.

5. A method for producing multi-page reports and the like which are provided in indexed, stacked form comprising the steps of providing means at one end of a production line for delivering web means for receiving printed information, providing backstop means at the other line end for receiving sheets cut from said web means with printed information on said sheets and arranged in indexed form for ready separation into individual reports with index sheets protecting toward said one end, printing said web means between said ends by applying printed information thereto by printer means, providing rotary knife means for producing report sheets wherein at least one end sheet of each report is of different length from the other sheets, advancing said web means through said knife means and transversely cutting the same, and cyclically changing the speed relationship of said knife means to the speed of said web means toward said knife means to develop said one end sheet and a compensating length sheet all while maintaining continuous motion with said printer means, determining when a predetermined number of cut sheets abut said backstop means, introducing finger means above said predetermined number of cut sheets and lowering said predetermined number.

6. A method for creating a plurality of multi-page reports comprising the steps of continuously advancing a web through a printer, printing a multi-page report in sequence on said web, transversely severing said web between successive pages of said report to provide pages of equal length and adjusting the severance at one end of the report to create different length sheets to provide a protruding index sheet, said severing step including engaging a rotating knife with a stationary knife to impart advancing movement to each of said sheets while maintaining constant the speed relationship of said web relative to said rotary knife, and advancing said sheets toward and against a backstop, said severing step also including changing the speed relationship of said rotating knife and said web during adjacent cycles of rotation to produce said different length sheets and to cause one sheet each cycle to project rearwardly relative to the direction of advance and beyond the shorter length sheets of said report by virtue of said sheets engaging said backstop.

7. The method of claim 6 in which said steps include providing upper and lower belts defining a nip between said knife and said back stop, advancing said sheets into said nip, speeding said sheets to produce a gap therebetween, and slowing the advance of said sheets to provide a shingled array of sheets.

8. Apparatus for producing multi-page reports and the like which reports are provided in indexed, stacked form comprising means at one end of a production line for delivering web means for receiving printed information, backstop means at the other line end for receiving in abutting relation sheets cut from said web means with printed information on said sheets and arranged in indexed form for ready separation into individual reports with the index sheets projecting toward said one end, means for continuously advancing said web means from said one end toward said other line end, printer means for said web means between said ends for applying printed information to said web means, rotary knife means between said ends for producing report sheets wherein at least the first page is of different length from the other sheets and, means for cyclically changing the speed relationship of said knife means and said web means to develop both longer and shorter sheets and to cause a longer sheet each cycle to project rearwardly relative to the direction of advance and beyond the shorter sheets of said report by virtue of abutting said backstop means.

9. Apparatus for producing multi-page reports and the like which reports are provided in indexed, stacked form comprising means at one end of a production line for delivering web means for receiving printed information, backstop means at the other line end for receiving sheets cut from said web means with printed information on said sheets and arranged in indexed form for ready separation into individual reports with the index sheets projecting toward said one end, printer means for said web means between said ends for applying printed information to said web means, rotary knife means between said ends for producing report sheets wherein at least the first page is of different length from the other sheets and, means for cyclically changing the speed relationship of said knife means and said web means to develop both longer and shorter sheets, said printer means to positioned in said production line upstream of said rotary knife means, said line including upper and lower belt systems immediately downstream of said knife means defining a nip for receiving said cut sheets.

10. Apparatus for producing multi-page reports and the like which reports are provided in indexed, stacked form comprising means at one end of a production line for delivering web means for receiving printed information, backstop means at the other line end for receiving sheets cut from said web means with printed information on said sheets and arranged in indexed form for ready separation into individual reports with the index sheets projecting toward said one end, printer means for said web means between said ends for applying printed information to said web means, rotary knife means between said ends for producing report sheets wherein at least the first page is of different length from the other sheets and, means for cyclically changing the speed relationship of said knife means and said web means to develop both longer and shorter sheets, said printer means being positioned in said production line upstream of said rotary knife means, said line including upper and lower belt systems immediately downstream said knife means defining a nip for receiving said cut sheets, said line including means for advancing said web means at one speed and further means for advancing said belt systems at a faster speed than said one speed and thereafter means to shingle said cut sheets.

* * * * *